US007571616B2

(12) United States Patent
Yamanaka et al.

(10) Patent No.: US 7,571,616 B2
(45) Date of Patent: Aug. 11, 2009

(54) COOLING APPARATUS FOR ARTICLES OPERATED AT LOW TEMPERATURE

(75) Inventors: Kazunori Yamanaka, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 327 days.

(21) Appl. No.: 11/113,200

(22) Filed: Apr. 25, 2005

(65) Prior Publication Data

US 2005/0204748 A1 Sep. 22, 2005

Related U.S. Application Data

(63) Continuation of application No. PCT/JP03/04028, filed on Mar. 28, 2003.

(51) Int. Cl.
*F25B 21/02* (2006.01)

(52) U.S. Cl. ..... 62/3.7; 62/3.2; 62/335

(58) Field of Classification Search ..... 62/3.2–3.7, 62/333, 335

See application file for complete search history.

(56) References Cited

U.S. PATENT DOCUMENTS

| | | | | |
|---|---|---|---|---|
| 4,065,936 | A * | 1/1978 | Fenton et al. | 62/3.3 |
| 5,715,684 | A | 2/1998 | Watanabe et al. | |
| 5,802,856 | A * | 9/1998 | Schaper et al. | 62/3.7 |
| 5,884,485 | A * | 3/1999 | Yamaguchi et al. | 62/3.2 |
| 5,940,784 | A * | 8/1999 | El-Husayni | 702/130 |
| 5,987,891 | A * | 11/1999 | Kim et al. | 62/3.6 |
| 6,018,616 | A * | 1/2000 | Schaper | 392/418 |
| 6,101,815 | A * | 8/2000 | van Oort et al. | 62/3.4 |
| 6,119,460 | A * | 9/2000 | Huang | 62/3.3 |
| 6,298,670 | B1 * | 10/2001 | Pundak | 62/6 |
| 6,345,507 | B1 * | 2/2002 | Gillen | 62/3.7 |
| 6,825,681 | B2 * | 11/2004 | Feder et al. | 324/760 |
| 6,999,741 | B2 * | 2/2006 | Hattori | 455/254 |
| 2002/0033546 | A1 | 3/2002 | Kojima et al. | |

FOREIGN PATENT DOCUMENTS

| | | |
|---|---|---|
| JP | 08-242022 | 9/1996 |
| JP | 9-287837 | 11/1997 |

(Continued)

OTHER PUBLICATIONS

Japanese Office Action dated Feb. 20, 2007, issued in corresponding Japanese Application No. 2004-570141.

(Continued)

*Primary Examiner*—Ljiljana (Lil) V Ciric
(74) *Attorney, Agent, or Firm*—Westerman, Hattori, Daniels & Adrian, LLP.

(57) ABSTRACT

A cooling apparatus for articles operated at low temperatures comprises a refrigerating machine and a cold head provided in the refrigerating machine. A first Peltier element is thermally contacted and fixed with the cold head, and a second Peltier element is thermally contacted and fixed with the cold head. A first article can be arranged with the first Peltier element with being thermally contacted therewith, and a second article can be arranged with the second Peltier element with being thermally contacted therewith. The cold head is cooled to low temperatures by the refrigerating machine, and temperatures of the first article and the second article each is further controlled by the first Peltier element and the second Peltier element, respectively, to thereby cool the articles to different temperatures.

9 Claims, 3 Drawing Sheets

FOREIGN PATENT DOCUMENTS

| | | | |
|---|---|---|---|
| JP | 11-186922 | | 7/1999 |
| JP | 2000-258019 | A | 9/2000 |
| JP | 2001-144635 | | 5/2001 |
| JP | 2002-80246 | A | 3/2002 |
| JP | 2003-020211 | A | 1/2003 |
| JP | 2003-0220209 | A | 1/2003 |
| JP | 2003-068626 | A | 3/2003 |

OTHER PUBLICATIONS

Japanese Office Action dated Nov. 2, 2006, issued in corresponding Japanese Patent Application No. 2004-570141.

* cited by examiner

COOLING APPARATUS FOR ARTICLES OPERATED AT LOW TEMPERATURE

CROSS-REFERENCE TO RELATED APPLICATION

This application is a continuation of PCT/JP03/04028, filed on Mar. 28, 2003, the contents being incorporated herein by reference.

TECHNICAL FIELD

The present invention relates to a cooling apparatus for two or more articles operated at, for example, temperatures not higher than 100K. Especially, the present invention relates to a cooling apparatus capable of independently cooling two or more electronic devices or electronic circuit units at finely adjusted temperatures.

BACKGROUND ART

For example, in order to cool superconductors operated at a temperature of not higher than 100K, a refrigerating machine such as a pulse tube refrigerating machine or a sterling refrigerating machine is used. For example, JP-A-2001-144635 discloses cooling of a wireless receiving unit by using a pulse tube refrigerating machine. This wireless receiving unit includes a receiving band filter and a low noise receiving amplifier. Further, according to the technique disclosed in JP-A'635, a Peltier element is fixed to the refrigerating machine, and the receiving band filter and the low noise receiving amplifier are fixed to Peltier element, so that the wireless receiving unit can be further cooled to a temperature lower than the temperature generated by the refrigerating machine. Thus, it is possible to remove the heat from the wireless receiving unit and operate the wireless receiving unit at low temperatures without increasing the cooling capacity of the refrigerating machine.

Recently, there is a demand that the temperature of a circuit device including a superconductor is lowered and also the low temperature is precisely controlled. Especially, when two or more electronic devices or electronic units are contained in one circuit device, there is a demand that the electronic devices and electronic units are cooled to temperatures which are different from and close to each other.

To satisfy the above demand, it is necessary to use a multiple stage refrigerating machine or two or more refrigerating machines. For example, when a two stage type refrigerating machine is used, it is necessary in a vacuum space of a cryostat that a cooling end (cold head) of the first stage is set at a temperature of about 20K and a cooling end (cold head) of the second stage is set at a temperature of about 70K, and also a first article to be cooled is arranged in the first cold head and a second article to be cooled is arranged in the second cold head. A temperature sensor and heater are provided when necessary, and the wirings of the temperature sensor and heater are drawn from the vacuum container to connect them to a control unit arranged outside the vacuum container. The temperatures of the first and second article to be cooled are respectively controlled to a desired temperature, accordingly.

When two or more refrigerating machines are used, the number of the refrigerating machines is selected to be the same as that of the articles to be cooled, and the articles are cooled by the respective refrigerating machines. In this method, as in the multiple stage type refrigerating machine described above, a temperature sensor and heater are arranged when necessary, and temperatures of the articles are respectively controlled to a desired temperature.

However, according to the methods described above, since two or more articles to be cooled have to be cooled to different temperatures, it is necessary to use a refrigerating machine having the complicated structure, and also to use a plurality of refrigerating machines, thereby making the entire structure complicated, along with extension of a space for the cryostat. Further, when it is desired that a plurality of articles to be cooled are located close to each other, many problems tend to occur. Furthermore, even when a necessary difference between the cooling temperatures is a small amount of about 5 to 30K, a cooling device having the complicated structure must be used, and thus the articles to be cooled must be arranged under the restricted conditions.

DISCLOSURE OF THE INVENTION

An object of the present invention is to provide a cooling apparatus for articles operated at low temperatures, for example, those operated at temperatures of not higher than 100K, which enables to cool a plurality of articles to temperatures which are different from and close to each other.

The present invention provides a cooling apparatus for articles operated at a low temperature comprising a refrigerating machine, a cold head arranged in the refrigerating machine, a first Peltier element fixed to and thermally contacted with the cold head, and a second Peltier element fixed to and thermally contacted with the cold head, wherein a first article can be arranged while it is thermally contacted with the first Peltier element, a second article can be arranged while it is thermally contacted with the second Peltier element, and the first and second articles are cooled to different temperatures.

Applying the above constitution to the cooling apparatus, the cold head is cooled by the refrigerating machine, and temperatures of the first and second articles are further controlled by the first and second Peltier elements, thereby enabling to cool the first and second articles to different temperatures. Accordingly, two or more articles to be cooled such as high frequency circuit parts and high speed digital circuit parts can be precisely cooled to temperatures which are different from and close to each other.

BEST MODE FOR CARRYING OUT THE INVENTION

Figure 1:
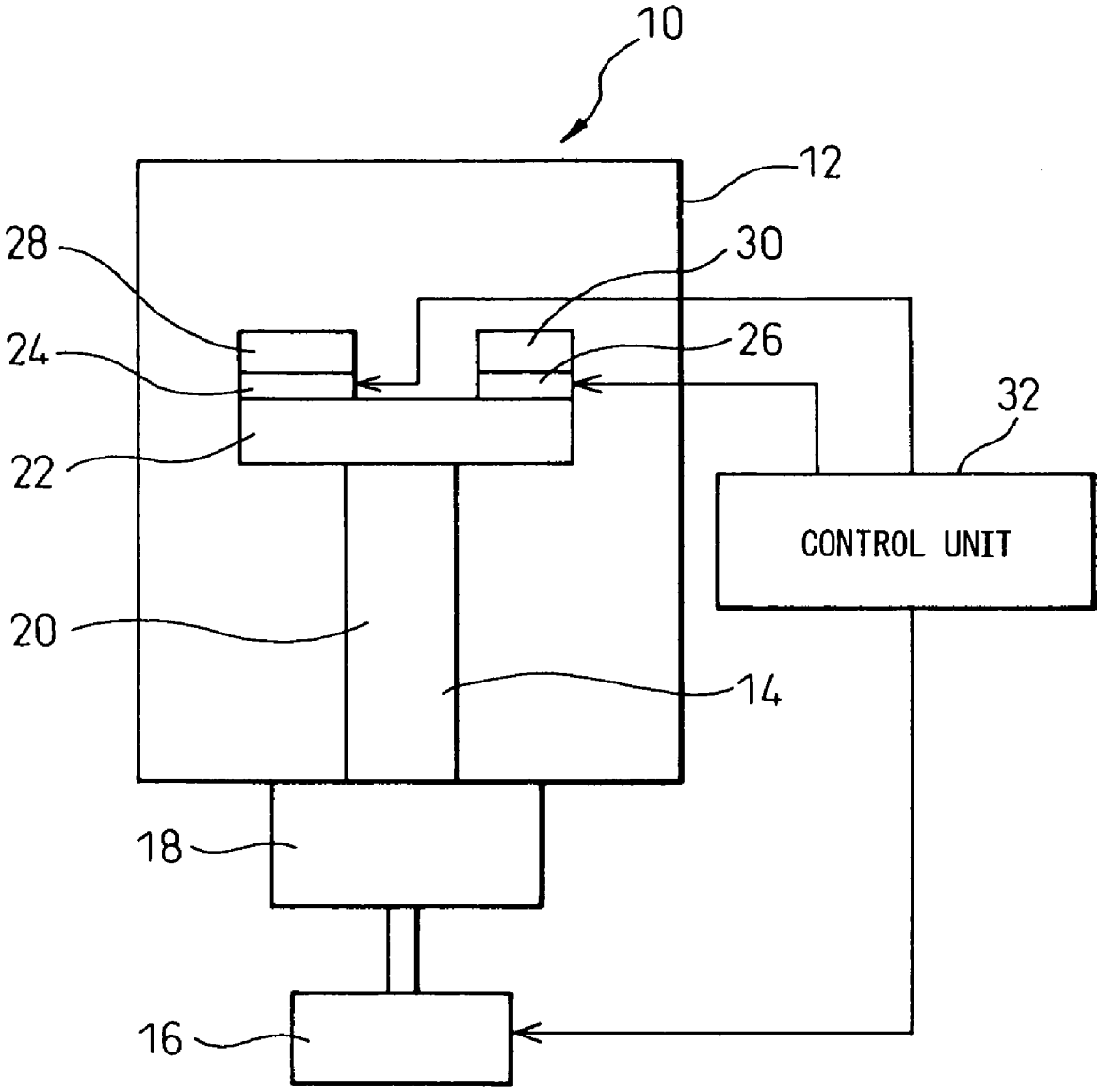
FIG. 1 is a schematic view showing a cooling apparatus for low temperature-operating articles according to one embodiment of the present invention.

FIG. 1 is a schematic view showing a cooling device for articles operated at low temperatures according to one embodiment of the present invention. The cooling device 10 comprises a vacuum container 12 composing a cryostat and a refrigerating machine 14 (constituted from 20, 22, 18, and 16 and others). The refrigerating machine 14 is composed of, for example, a pulse tube refrigerating machine. It is also possible to use any refrigerating machine other than the pulse tube refrigerating machine, for example, Stirling refrigerating machine. The refrigerating machine 14 comprises a compressor 16, an expander 18 and a column support 20 constituting a portion of the expander 18. The compressor 16 can vibrate gas such as helium charged into the expander 18, to thereby expand and contract gas by the columnar support 20, and thus generating low temperatures.

The cooling end (cold head) 22 is provided at the forward end portion of the column support 20. The first Peltier element 24 is thermally contacted with and fixed to the cold head 22, and the second Pettier element 26 is thermally contacted with and fixed to the cold head 22. The first Peltier element 24 and the second Peltier element 26 are respectively arranged at positions close to the common cold head 22. The cooling device 10 of this example is constituted in such a manner that two articles can be cooled, however, it will be appreciated that three or more articles can be cooled when the number of Pettier elements is increased.

It is constituted that the first article 28 is thermally contacted with and fixed to the first Peltier element 24, and the second article 30 is thermally contacted with and fixed to the second Peltier element 26. For example, each of the first article 28 and the second article 30 has an appearance of a rectangular parallelepiped. Each article has a height of 1 to 5 cm, and the width and depth each is about 2 to 10 cm. Each of the first Peltier element 24 and the second Peltier element 26 has a configuration of a flat plate, and its thickness is 0.1 to 1 cm, and the length of the side is approximately 0.5 to 5 cm.

The column support 20 of the refrigerating machine 14, the cold head 22, the first Peltier element 24, the second Peltier element 26, the first article 28 and the second article 30 are contained in an interior of vacuum container 12. The control unit 32 is disposed outside the vacuum container 12. The refrigerating machine 14, the first Peltier element 24 and the second Peltier element 26 are controlled by the control unit 32 depending upon an output of the temperature sensor, not shown. As a result, the cold head 22 is cooled to low temperatures by the refrigerating machine 14, and the temperatures of the first article 28 and the second article 30 are further controlled by the first Peltier element 24 and the second Peltier element 26, respectively, thereby cooling the first article 28 and the second article 30 to different temperatures. Accordingly, two or more articles to be cooled such as high frequency circuit parts or high speed digital circuit parts can be precisely cooled to low temperatures which are different from and close to each other.

Figure 3:
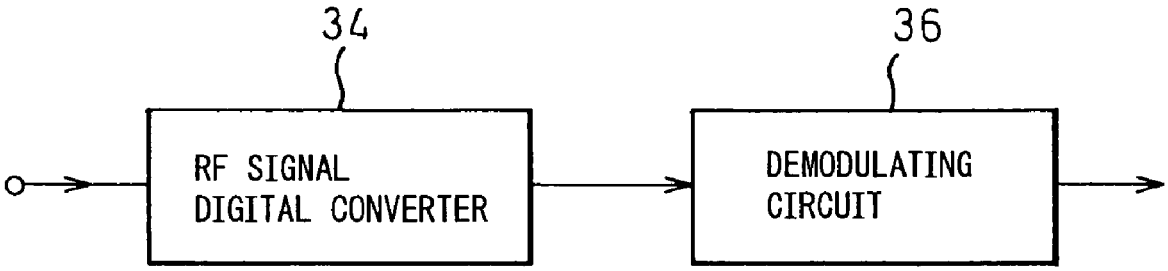
FIG. 3 is a schematic view showing an example of the high frequency receiving signal digital converter-demodulator to which the present invention can be applied.
Figure 4:
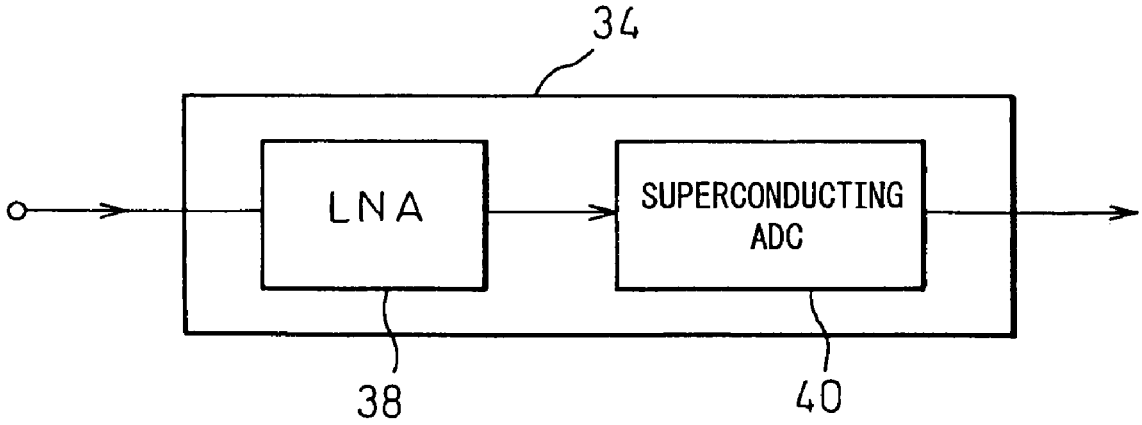
FIG. 4 is a schematic view showing the constitution of the high frequency digital converter of FIG. 3.

FIG. 3 is a view showing one example of the high frequency receiving signal digital conversion-demodulation device to which the present invention can be applied. In FIG. 3, the high frequency receiving signal digital conversion-demodulation device comprises RF signal digital conversion device 34 for imputing the received RF signal and a demodulating circuit 36 connected to RF signal digital conversion device 34. FIG. 4 is a view showing RF signal digital conversion device 34 illustrated in FIG. 3. In FIG. 4, RF signal digital conversion device 34 comprises a low noise high frequency amplifier (LNA) 38 and a superconducting ADC 40. The superconducting ADC 40 is an ADC (analog-digital signal converter) comprising a high temperature superconducting SFQ circuit, and LNA 38 has a characteristic of reducing noise at low temperatures. Superconducting ADC 40 corresponds to the first article 28 shown in FIG. 1, and LNA 38 corresponds to the second article 30 shown in FIG. 1. Note that in addition to the application to a high frequency receiving device, the present invention can be also applied to other devices using a superconductor and a high frequency circuit or a high speed digital circuit using a semiconductor.

Figure 2:
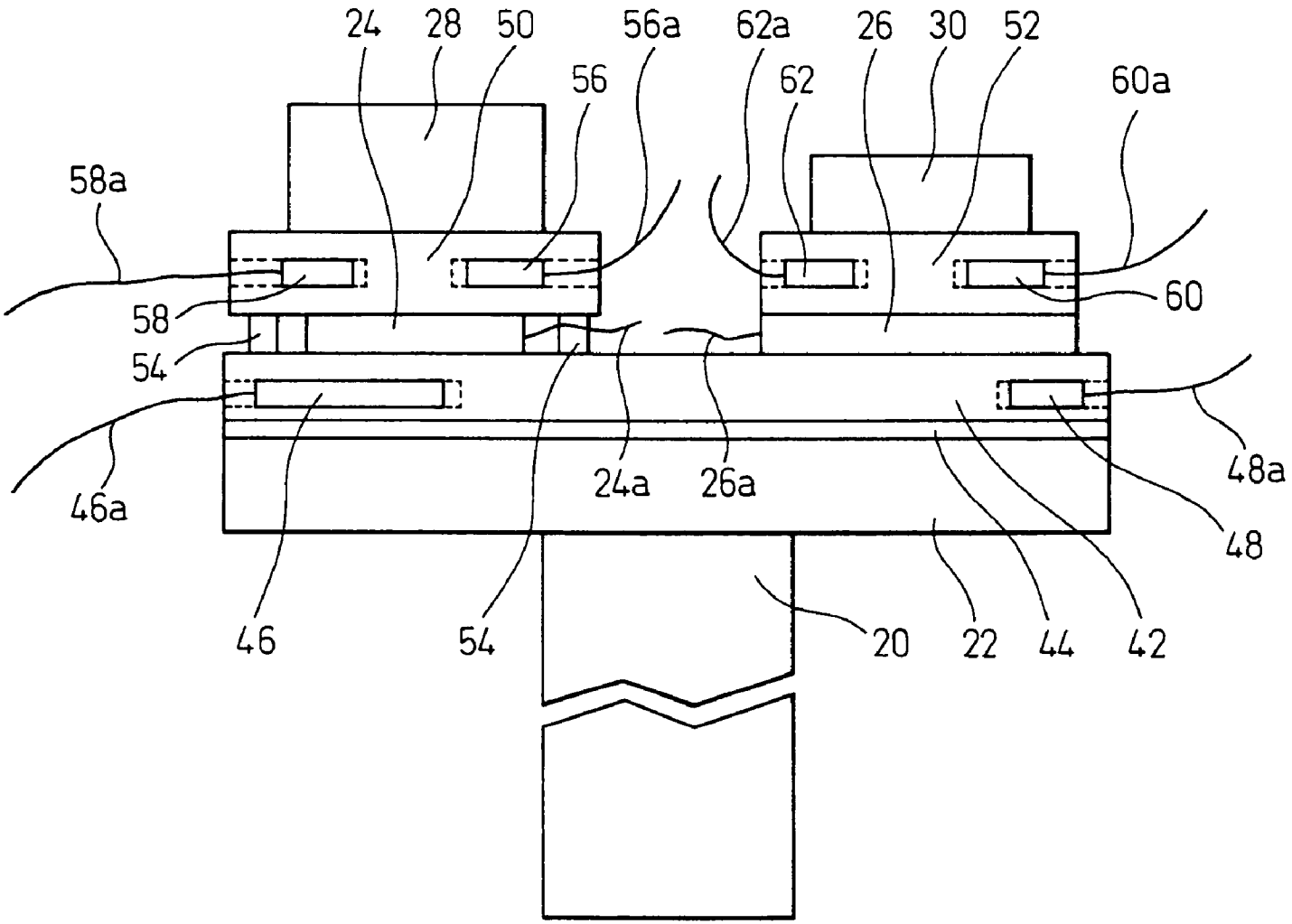
FIG. 2 is an enlarged cross-sectional view showing the portion, including the cold head, of FIG. 1.

FIG. 2 is an enlarged view showing the detail of a portion, including the cold head, of FIG. 1. The support plate (metallic block) 42 is fixed through the indium sheet (In sheet) 44 to the cold head 22, the thickness of the In sheet 44 being 0.1 to 0.2 mm. The heater 46 and the temperature sensor 48 are embedded in an interior of the support plate 42. The heater 46 is connected to the lead wiring 46*a*, and the temperature sensor 48 is connected to the lead wiring 48*a*. The lead wiring 46*a* and 48*a* are drawn from the inside of the vacuum container 12 (FIG. 1) to the outside of the vacuum container 12 while maintaining good airtight conditions, and connected to the control unit 32.

The support plate 42 is cooled by the refrigerating machine 14 to adjust the temperature to about a value close to the predetermined temperatures. The temperature of the support plate 42 is detected by the temperature sensor 48 and adjusted to the predetermined value by the heater 46. In sheet 44 has plasticity at low temperatures, and thus, as in the thermal grease used at the ordinary temperature, it can enhance the thermal contact of the cold head 22 with the support plate 42. In place of In sheet 44, it is also possible to use a sheet such as a graphite sheet having the same function as that of In sheet. Although not shown in FIG. 2, the sheets similar to In sheet 44 may be used for any joining portions between other members.

The first Peltier element 24 and the second Peltier element 26 are fixed to the support plate 42, and thus the first Peltier element 24 and the second Peltier element 26 are thermally contacted with the cold head 22 via the support plate 42. The first Peltier element 24 is connected to two lead wiring 24*a*, and the second Peltier element 26 is connected to two lead wiring 26*a*. The first and second Peltier element 24 and 26 each has a PN junction. When an electric current is applied to each of the first and second Peltier element 24 and 26, one surface of Peltier element becomes a heat absorbing surface (low temperature surface), and the other surface of Peltier element becomes a heating surface (high temperature surface). Preferably, the respective heat absorbing surfaces of the first Peltier element 24 and the second Peltier element 26 are fixed to the support plate 42, and thus the heat absorbing surfaces are arranged so that they can be thermally contacted with the cold head 22. In this case, temperatures of the first article 28 and the second article 30 are increased to the temperature higher than that of the support plate 42.

The first metallic block 50 is provided on the surface (heating surface) of the first Peltier element 24 on the opposite side to the cold head 22, and the first article 28 is attached to the first Peltier element 24 via the first metallic block 50. The second metallic block 52 is arranged on the surface (heating surface) of the second Peltier element 26 on the opposite side to the cold head 22, and the second article 30 is attached to the second Peltier element 26 via the second metallic block 52. The first metallic block 50 and the second metallic block 52 can act as a supporting table for the first article 28 and the second article 30, respectively.

To ensuring fixation of the first article 28 to the support plate 42, the cylindrical spacer 54 is arranged between the support plate 42 and the first metallic block 50 in parallel with the first Peltier element 24. In this embodiment, four spacers 54 are disposed around the first Peltier element 24. Any spacers similar to the spacer 54 can be disposed around the second Peltier element 26. In this embodiment, since the first article 28 is relatively heavy, the spacers are provided around the first Peltier element 24 to avoid application of an excessively heavy load to the first Peltier element 24.

The heater 56 and the temperature sensor 58 are embedded in an interior of the first metallic block 50. The heater 56 is connected to the lead wiring 56*a*, and the temperature sensor 58 is connected to the lead wiring 58*a*. In the same manner, the heater 60 and the temperature sensor 62 are embedded in an interior of the second metallic block 52. The heater 60 is connected to the lead wiring 60*a*, and the temperature sensor 62 is connected to the lead wiring 62*a*. The lead wiring 24*a*, 26*a*, 56*a*, 58*a*, 60*a* and 62*a* are airtightly drawn from an interior of the vacuum container 12 (in FIG. 1) to the outside portion, and connected to the control unit 32. The heaters 46, 56 and 60 having a configuration of a can, and each heater has two lead wiring.

The temperature sensor 58 detects a temperature of the first article 28 thermally contacted with the first Peltier element 24, and the temperature sensor 62 detects a temperature of the second article 30 thermally contacted with the second Peltier element 26. Temperatures of the first article 28 and the second article 30 are adjusted by the actions of the first Peltier element 24 and the second Peltier element 26 with respect to the temperature of the support plate 42. Since the heat absorbing surfaces of the first Peltier element 24 and the second Peltier element 26 are fixed to the support plate 42, the temperatures of the first article 28 and the second article 30 are increased to the temperature higher than the temperature of the support plate 42. When necessary, the temperatures of the first article 28 and the second article 30 are more precisely adjusted to the predetermined values by the heaters 56 and 60.

According to the present invention, since the first article 28 and the second article 30 are thermally contacted with the support plate 42 via the first Peltier element 24 and the second Peltier element 26, respectively, it is possible to precisely cool the first article 28 and the second article 30 to temperatures which are different from and close to each other. For example, the temperature of the support plate 42 can be controlled to 70K, the temperature of the first article 28 can be controlled to 75K, and the temperature of the second article 30 can be controlled to 72K. Further, it is possible to use the conventional single refrigerating machine 14.

The cold head 22, the support plate 42, the first metallic block 50 and the second metallic block 52 are made of a metal having good heat conductivity such as copper (oxygen-free copper) or aluminum. Parts can be attached to each other by using screws, for example.

On the other hand, the spacer 54 is made of a material having low heat conductivity. That is, it is desirable that heat is transferred from the support plate 42 to the first metallic block 50 only through the first Peltier element 24, that is, heat is not transferred through the spacer 54. Preferably, the spacer 54 is made of a material showing the heat conductivity of not more than 1 W/(cm·K) in the operation temperature region not more than 100K and not less than 3K. For example, the spacer 54 is made of at least one material selected from the group of stainless steel, invar, kovar, brass, Ti—V alloy, copper-Ni alloy, PI, aramid resin, PMA, PTFE, polycarbonate, glass epoxy resin and glass PTFE resin, or a composite of these materials.

In summary, according to the present invention, the heat absorbing surfaces of the Peltier elements 24 and 26 are thermally contacted with the cooling end cooled by the refrigerating machine 14 or refrigerant, the articles 28 and 30 to be cooled are arranged on and thermally contacted with the heating surfaces of the Peltier elements 24 and 26, temperatures of the individual articles 28 and 30 are detected by the temperature sensors 58 and 62 disposed near and thermally contacted with the articles 28 and 30, and the individual Peltier elements 24 and 26 are driven by the control unit 32 to thereby adjust the temperatures of the articles 28 and 30 to the predetermined temperatures.

The basic temperatures of the articles 28 and 30 can be determined by the temperature control of the cooling end cooled by the refrigerating machine 14 or the refrigerant, and when no electric currents flow in the Peltier elements 24 and 26, the temperatures of the articles 28 and 30 can be controlled by the heat introduced from the outside of the heat insulating container 12 and the heat generated by the articles 28 and 30 and also by the heat resistance between the articles 28 and 30 and the cooling end. The temperatures of the articles 28 and 30 can be generally controlled to a temperature slightly higher than the temperature of the cooling end (temperature difference of 0 to 10K).

When the respective Peltier elements 24 and 26 are not operated, the temperature difference between the respective articles 28 and 30 and the cooling end can be suppressed by enhancing the heat insulation of the vacuum container 12 from its outside and by reducing the generation of heat from the articles 28 and 30. On the basis of the above temperature conditions, the Peltier elements 24 and 26 are operated in such a manner that an article side is heated, when the temperatures of the articles are lower than a desired temperature.

The control unit 32 is provided outside the vacuum container 12, and can conduct the temperature control at the resolution of, for example, 0.01K. When the output of the refrigerating machine can be electrically changed, temperature control of the heater 46 is not necessarily required. According to the described embodiment, under the condition that the first article 28 and the second article 30 are located close to each other, the temperature difference of 0 to 5K can be stably realized at the control resolution of 0.01K, at the base temperature of 70K of the cold head 22. Further, when a resonator having the resonance frequency varied depends upon the temperature is internally contained in each of the first article 28 and the second article 30, the frequency can be independently changed in each of the articles 28 and 30. Since the first article 28 and the second article 30 can be arranged close to each other, the transmission loss can be reduced. Further, since the heat absorbing surfaces of the Peltier elements 24 and 26 are thermally contacted with the cooling end on the refrigerating machine side, it is possible to suppress an increase in the load to the refrigerating machine 14 even during heating of the articles 28 and 30 by the first and second Peltier element 24 and 26. For example, when the heating surfaces of the Peltier elements 24 and 26 are thermally contacted with the cooling end on the refrigerating machine side, the support plate 42 can receive heat from the Peltier elements 24 and 26.

With regard to the individual temperature sensors 48, 58 and 62, the measurements can be carried out by the control unit 32 provided outside the vacuum container 12. Based on the measurement results, the first and second Peltier element 24 and 26 are operated to obtain the desired temperature control value in each element. The first and second Peltier element 24 and 26 are operated so that the first article 28 and the second article can be heated, when the temperatures of the first and second articles 28 and 30 are lower than the predetermined temperatures. Furthermore, the temperature control of the first and the second Peltier elements 24 and 26, the heaters 46, 56 and 60 and the refrigerating machine 14 is conducted by using a PID control system, and a limiter is provided for preventing an output of each control unit from overdriving.

Capability of Exploitation in Industry

As explained above, according to the present invention, it becomes possible to realize a cooling apparatus capable of operating at a temperature of not higher than 100K and also capable of controlling a temperature difference in the range of about 0 to 30K, especially in the range of about 0 to 5K, in two or more electronic devices and electronic circuits, while ensuring that the cooling temperatures of the individual devices and units are close to each other.

The invention claimed is:

1. A cooling apparatus for articles operated at a low temperature, comprising:

a refrigerating machine;

a cold head arranged in the refrigerating machine;

a first Peltier element fixed to and thermally contacted with the cold head; and a second Peltier element fixed to and thermally contacted with the cold head;

a first article arranged in thermal contact with the first Peltier element;

a second article arranged in thermal contact with the second Peltier element, wherein the first and second articles are cooled to different temperatures, the first and second Peltier elements are arranged so that respective heat absorbing faces thereof are directed to the cold head, a first metallic block is provided on a surface of the first Peltier element on the opposite side to the cold head, the first article is attached to the first Peltier element via the first metallic block, a second metallic block is provided on a surface of the second Peltier element on the opposite side to the cold head, the second article is attached to the second Peltier element via the second metallic block, and a heater is provided for each of the first and second metallic blocks.

2. The cooling apparatus according to claim 1, further comprising a sensor for detecting a temperature of the first article thermally contacted with the first Peltier element, and a sensor for detecting a temperature of the second article thermally contacted with the second Peltier element.

3. The cooling apparatus according to claim 1, wherein a structural member having a low heat conductivity is inserted between the cold head and at least one of the first and second metallic blocks, in parallel with at least the corresponding one of the first and second Peltier elements.

4. The cooling apparatus according to claim 1, wherein a third metallic block is provided between the cold head and the first and second Peltier elements, and a sheet showing plasticity at low temperatures is arranged between the cold head and the third metallic block.

5. The cooling apparatus according to claim 4, wherein a heater is provided in the third metallic block.

6. The cooling apparatus according to claim 1 further comprising a vacuum container for containing the cold head and the first and second Peltier elements, and a control unit arranged outside the vacuum container, wherein the wirings of the first and second Peltier elements are drawn from an inside of the vacuum container to an outside thereof under the airtight conditions, and connected to the control unit.

7. The cooling apparatus according to claim 1, wherein each of the first and second Peltier elements has a PN junction.

8. The cooling apparatus according to claim 1, wherein each of the first and second articles comprises a superconductor.

9. The cooling apparatus according to claim 1, wherein each of the first and second articles comprises a high frequency circuit or high speed digital circuit.

* * * * *